US006330416B1

(12) United States Patent
Yamada et al.

(10) Patent No.: US 6,330,416 B1
(45) **Date of Patent: *Dec. 11, 2001**

(54) BLADE FOR A DEVELOPING DEVICE AND METHODS OF MAKING THE SAME

(75) Inventors: Masanori Yamada, Ikoma; Tetsurou Toyoshima, Soraku-gun; Tadashi Iwamatsu, Nara; Nobuyuki Azuma, Ibaraki, all of (JP)

(73) Assignee: Sharp Kabushiki Kaisha, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/323,811

(22) Filed: Jun. 2, 1999

(30) Foreign Application Priority Data

Jun. 2, 1998 (JP) ..... 10-153277

(51) Int. Cl.[7] ..... G03G 15/08

(52) U.S. Cl. ..... 399/284; 399/274

(58) Field of Search ..... 399/284, 274; 118/261

(56) References Cited

U.S. PATENT DOCUMENTS

| | | | | |
|---|---|---|---|---|
| 4,777,904 | * | 10/1988 | Gundlach et al. | 399/384 |
| 5,338,895 | | 8/1994 | Ikegawa et al. | 118/661 |
| 5,373,353 | * | 12/1994 | Fukasawa | 399/284 |
| 5,552,867 | | 9/1996 | Sekino et al. | 355/245 |
| 5,587,551 | | 12/1996 | Ikegawa et al. | 118/661 |
| 5,752,146 | * | 5/1998 | Sato | 399/284 |
| 5,761,590 | * | 6/1998 | Sato | 399/284 X |
| 6,006,060 | * | 12/1999 | Sato | 399/284 |
| 6,021,299 | * | 2/2000 | Hansburg et al. | 399/284 |
| 6,064,463 | * | 5/2000 | Yamada et al. | 399/284 X |

FOREIGN PATENT DOCUMENTS

| | | | |
|---|---|---|---|
| 921445A2 | | 6/1999 | (EP) . |
| 921445A3 | | 7/2000 | (EP) . |
| 51-36070 | | 10/1976 | (JP) . |
| 60-15068 | | 4/1985 | (JP) . |
| 63-16736 | | 4/1988 | (JP) . |
| 5-346730 | | 12/1993 | (JP) . |
| 6-52449 | | 7/1994 | (JP) . |
| 7-140306 | * | 6/1995 | (JP) . |
| 8-220877 | * | 8/1996 | (JP) . |

OTHER PUBLICATIONS

European Search Report.
U.S. application No. 09/007,157, Unknown, Unknown.
U.S. application No. 09/204,811, Unknown, filed Dec. 3, 1998.

* cited by examiner

*Primary Examiner*—Quana M. Grainger
(74) *Attorney, Agent, or Firm*—David G. Conlin; Lisa Swiszcz Hazzard; Dike, Bronstein, Roberts & Cushman, IP Group

(57) ABSTRACT

A developing device and a blade of the developing device, includes a contact section which is in plane contact with a development roller, and an inclined section which extends from an end of the contact section so as to form a flare at an inflow section of a one-component developer between the blade and development roller. When a flare angle between the blade having the flare and a line tangent to the development roller is denoted by a tilt angle θ, $30° \leqq \theta \leqq 90°$. Thus, if the flare angle at the inflow section of the one-component developer between the blade and development roller is optimized, even when the one-component developer deteriorates with time, for example, the flowability is changed with time, it is possible to provide a developing device and a blade of the developing device capable of forming a one-component developer layer with an extremely stable deposit of one-component developer. Moreover, it is possible to provide a blade which can increase the dimensional tolerance of the inclined section and can be produced easily at a low cost.

20 Claims, 7 Drawing Sheets

BLADE FOR A DEVELOPING DEVICE AND METHODS OF MAKING THE SAME

FIELD OF THE INVENTION

The present invention relates to a developing device using a one-component developer of an electrophotographic-type image forcing apparatus, and a blade thereof, and more particularly to the blade which forms a thin film layer of the one-component developer on a surface of a development roller when it is pressed against the surface of the development roller. More specifically, the present invention relates to the adjustment of a flare angle at a one-component developer inflow section formed between the blade and development roller, and the fabrication of the blade.

BACKGROUND OF THE INVENTION

Since a developing device using a one-component developer containing no carrier (hereinafter referred to as the "toner") as developer has a simple structure and is producible at a low cost, it has advantages of reducing the size and limiting an increase in the cost. In particular, since a developing device using a non-magnetic one-component toner which does not use a magnetic toner does not require a magnet roller, it has an advantage of achieving a small, clear, inexpensive developing device.

In the developing device using the non-magnetic one-component toner, a blade as a toner layer thickness regulating member is provided so as to form a toner layer of a predetermined thickness on a development roller which is rotated to develop an electrostatic latent image on a photoreceptor.

Regarding the blade, various techniques have been conventionally disclosed.

For instance, Japanese publication of examined patent application No. (Tokukosho) 63-16736 (published on Apr. 11, 1988) discloses a blade. According to the technique disclosed in this publication, a surface of a plate-like member is brought into contact with a development roller, and the toner is regulated by pressing the plane or body of the blade against the development roller.

Meanwhile, Japanese publication of examined patent applications Nos. (Tokukosho) 51-36070 (published on Oct. 6, 1976) and (Tokukosho) 60-15068 (published on Apr. 17, 1985) disclose a blade whose tip or edge is brought into contact with a development roller.

By the way, among these known blades, a blade whose plane or body is brought into contact with a development roller has the following problems. Specifically, when toner which shows excellent fusion of the toner and excellent flowability for the supply of the toner to the development roller is used, it is necessary to increase the pressing force for pressing the blade against the development roller in order to ensure a desired toner deposit optimum for development. As a result, the driving torque of the development roller is increased.

In contrast, in the case of the blade whose tip or edge is brought into contact with the development roller, the toner layer becomes very thin. Therefore, a sufficient toner deposit for development can not be obtained in a stable manner.

On the other hand, there has been a compromising proposal between these blades to obtain a desired toner deposit under an intermediate condition between a condition that the plane or body of the blade is brought into contact with the development roller and a condition that the tip or edge of the blade is brought into contact with the development by adjusting the setting position of the blade. However, this proposal suffers from such a drawback that there is an extremely small margin for error in setting the position of the blade.

As means for overcoming the above-mentioned drawbacks, a blade whose tip has an L-shaped cross section is disclosed in Japanese publication of examined patent application No. (Tokukohei) 6-52449 (published on Jul. 6, 1994), U.S. Pat. Nos. 5,338,895, 5,373,353, 5,587,551, etc.

Moreover, a blade which is inclined at a small angle instead of forming its tip to have an L-shaped cross section is disclosed in U.S. Pat. No. 5,552,867, Japanese publication of unexamined patent applications Nos. (Tokukaihei) 7-64391 (published on Mar. 10, 1995) and (Tokukaihei) 7-239611 (published on Sep. 12, 1995). With such a blade, it is possible to achieve a desired toner deposit and increase the margin for error in the setting.

However, when the above-mentioned conventional one-component developer device uses a method for bringing into contact with the development roller a bent section of a blade having an L-shaped cross section as disclosed in Japanese publication of examined patent application No. (Tokukohei) 6-52449, U.S. Pat. Nos. 5,338,895, 5,373,353, 5,587,551, etc., the following problems arise. Specifically, when forming the inclined section by bending the blade to have a substantially L-shaped cross section as described above, distortion occurs due to the residual stress after bending. It is therefore difficult to ensure the straightness of the bent section of the blade, which comes into contact with the development roller. Thus, there is a problem that the toner layer has unevenness corresponding to the unevenness of the surface of the blade.

Incidentally, the tilt angle of the tip section of the blade disclosed in the above-mentioned U.S. Pat. No. 5,582,867 is between 5° and 15°. Furthermore, it is known from the contents of Japanese publication of unexamined patent applications Nos. (Tokukaihei) 7-64391 and (Tokukaihei) 7-239611 that the angles described in these documents are also limited substantially to the above range.

However, according to the study of the present inventors, the toner deposit is decreased and the image density is lowered under the above-mentioned conditions due to the deterioration of toner with time, such as deterioration of the flowability, caused by the separation of an additive from the surface of the toner.

Moreover, as disclosed in the above publications, since the toner deposit varies depending on the length of the inclined tip section, it is necessary to strictly control the dimensional tolerance of the length of the inclined tip section. Thus, it is difficult to fabricate the blade.

Furthermore, as described in the above-mentioned conventional example, when the blade is mechanically bent for the fabrication of the inclined section, the straightness of the blade deteriorates due to the residual stress after bending. Thus, there is a problem that a uniform toner layer can not be formed along an axis direction of the development roller.

Besides, when a rolled material is used as a material for the blade, a large distortion occurs due to the residual stress after rolling. As a result, like the above example, the straightness of the blade deteriorates, and a uniform toner layer can not be formed along an axis direction of the development roller.

SUMMARY OF THE INVENTION

An object of the present invention is to provide a developing device using a one-component developer and a blade thereof, which are capable of forming a developer layer with an extremely stable developer deposit even when the one-component developer deteriorates with time, for example, the flowability of the one-component developer is changed, by optimizing a flare angle at an inflow section of the one-component developer between the blade and a development roller, and also provide a developing device using a one-component developer and a blade thereof, which are easily fabricated at a low cost, by relaxing the dimensional tolerance at the inclined section.

Another object of the present invention is to provide a developing device using a one-component developer and a blade thereof, which are capable of forming a uniform developer layer along an axis direction of a development roller by reducing the influence of distortion due to the residual stress after mechanical bending the blade to form an inclined section and by maintaining the straightness of the blade.

In order to achieve the above objects, a blade of a developing device of the present invention is a blade with elasticity for stably supplying a one-component developer to a development roller for carrying the one-component developer on a surface thereof , the blade including a contact section which is pressed and brought into contact with the surface of the development roller, and an inclined section which extends from an end of the contact section so as to form a flare at an inflow section of the one-component developer between the blade and the development roller, wherein the inclined section is formed so that an angle θ between the inclined section and a line tangent to the development roller at the contact section has a value that stabilizes an amount of the one-component developer carried on the development roller.

According to this structure, the development roller carries the one-component developer on the surface thereof. In order to supply the one-component developer stably to the development roller, the blade having elasticity is provided. More specifically, the contact section of the blade is pressed and brought into contact with the surface of the development roller. The inclined section extending from an end of the contact section forms a flare at the inflow section of the one-component developer between the blade and development roller. Namely, the one-component developer flows from the flare and is supplied to the development roller.

For instance, when the inclined section of the blade only forms a flare between the blade and development roller, the amount of one-component developer carried on the development roller decreases as the one-component developer deteriorates with time, and the density of a developed image is lowered.

However, according to the above-mentioned structure, the angle θ between a line tangent to the development roller at the contact section and the inclined section is set at a value that allows the development roller to carry a stable amount of the one-component developer. Compared with a case where the angle θ is not set at such a value, the above-mentioned structure can reduce the influence of the deterioration of the one-component developer with time on the amount of the one-component developer carried on the development roller. As a result, a uniform amount of one-component developer can be always carried on the development roller, thereby preventing a lowering of the image density.

Besides, it is preferred that the above-mentioned blade is made of a metal plate obtained by rolling, and the inclined section is formed by mechanically bending the metal plate to have a bend line in a direction determined by the rolling direction of the metal plate.

According to this structure, the blade is made of a metal plate obtained by rolling a metal material. The inclined section of the blade is formed by mechanically bending the metal plate, and a direction of the bend line is determined by the rolling direction of the metal plate, for example, is perpendicular to the rolling direction.

The metal plate obtained by rolling is sometimes distorted by the residual stress. In this case, the distortion in a direction parallel to the rolling direction is maximum. For example, when the blade is made of such a metal plate obtained by rolling and distortion occurs at the contact section of the blade, the straightness of the contact section deteriorates. Consequently, a one-component developer layer with a uniform thickness can not be formed on the development roller.

However, according to the above-mentioned structure, since the direction of the bend line formed during mechanical bending is determined based on the rolling direction of the metal plate, it is possible to minimize the influence of the distortion by appropriately setting the direction of the bend line. For instance, when the direction of the bend line is arranged to be perpendicular to the rolling direction, the influence of the distortion is minimum in the direction of the bend line. As a result, the straightness of the contact section of the blade in the direction of the bend line is not deteriorated. It is therefore possible to form a one-component developer layer with a uniform thickness on the surface of the development roller, and prevent unevenness of the image density.

For a fuller understanding of the nature and advantages of the invention, reference should be made to the ensuing detailed description taken in conjunction with the accompanying drawings.

DESCRIPTION OF THE PREFERRED EMBODIMENT

Referring to FIGS. 1 to 7, the following descriptions will explain one embodiment of a developing device using a one-component developer of the present invention and a blade thereof by illustrating an image forming apparatus including the developing device and the blade.

Figure 2:
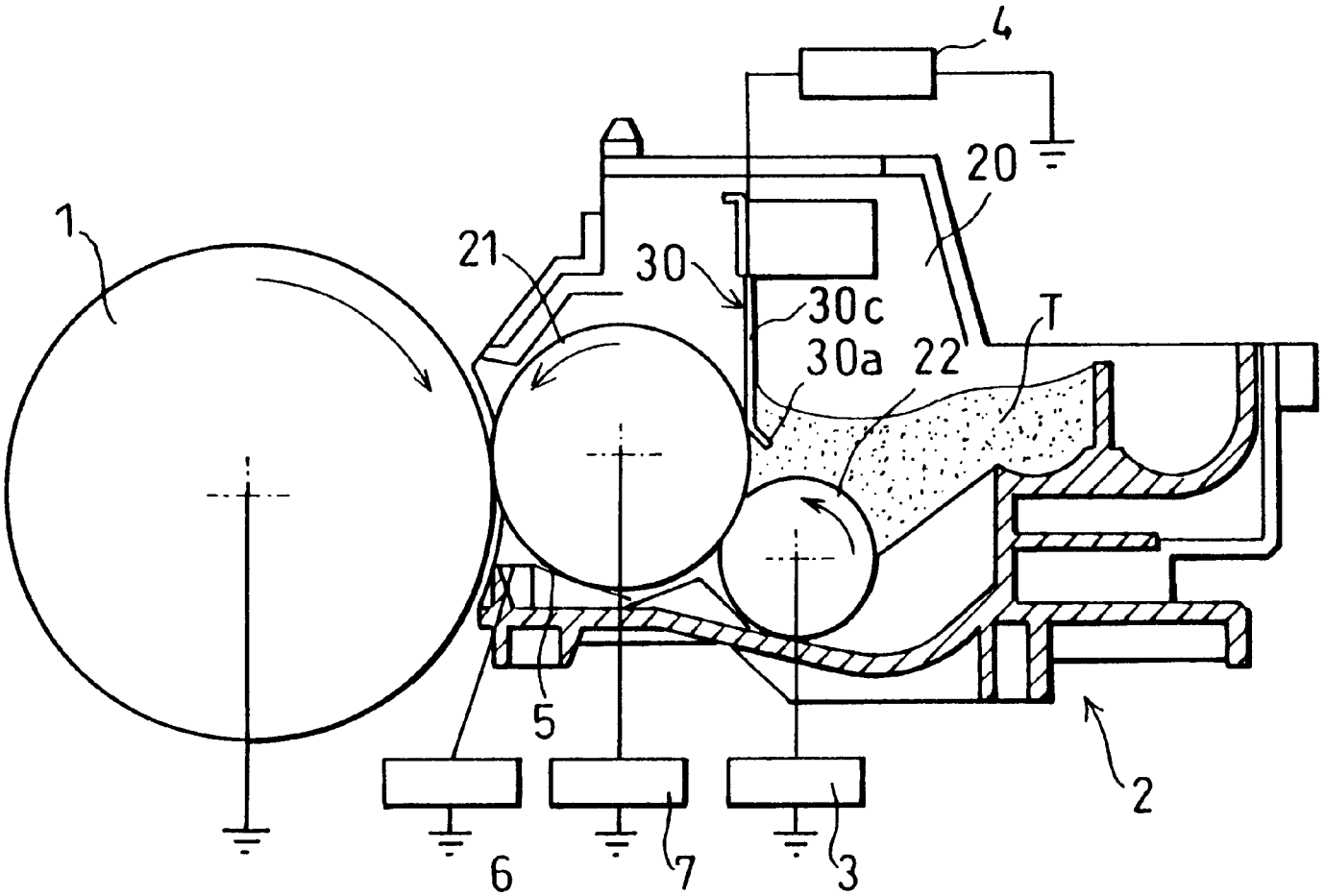
FIG. 2 is a schematic structural view showing the entire developing device.

As illustrated in FIG. 2, the image forming apparatus includes a drum-shaped photoreceptor 1 at substantially the center of the main body of the apparatus.

The photoreceptor 1 is rotated in the direction of an arrow (for example, a clockwise direction) at a uniform speed in an image forming operation. photoreceptor 1. Although not shown in the drawings, the image formation processing means include a charging device, an optical system, a developing device 2, a transfer device, a cleaning device, and a charge removing device arranged in this order along a rotating direction of the photoreceptor 1. The charging device uniformly charges the surface of the photoreceptor 1. The optical system projects a light image corresponding to an image onto the photoreceptor 1 (exposure). The developing device 2 develops an electrostatic latent image formed on a surface of the photoreceptor 1 by the exposure into a visible image. The transfer device transfers a developed image (a toner image, not shown) to a sheet of transfer paper transported suitably. After the transfer, the cleaning device removes residual developer (residual toner) which has not been transferred to the surface of the photoreceptor 1. The charge removing device removes the charges remaining on the surface of the photoreceptor 1.

A large amount of the transfer paper is stored in, for example, a tray or a cassette. The stored transfer paper is fed one sheet at a time by a feeding device, and sent to a transfer region where the above-mentioned transfer device faces the photoreceptor 1. The transfer paper is sent to the transfer region so that it coincides with the leading end of the toner image formed on the surface of the photoreceptor 1. Then, the toner image is transferred.

After the transfer, the transfer paper is separated from the photoreceptor 1, and sent to a fixing device. The fixing device fixes the unfixed toner image transferred to the transfer paper as a permanent image. The fixing device includes a heat roller and a pressure roller. The heat roller is provided on a plane facing the toner image on the transfer paper, and heated to a temperature for fixing the toner by fusion in the fixing step. The pressure roller adheres the transfer paper heated by the heat roller to the heat roller. The transfer paper which has passed through the fixing device is output onto an output tray provided outside of the image forming apparatus through an output roller.

In the case where the image forming apparatus is a copying machine, the optical system (not shown) illuminates a document to be copied, with light, and projects reflected light from the document as a light image onto the photoreceptor 1, i.e., performs exposure. On the other hand, if the image forming apparatus is a printer or a digital copying machine, the optical system drives a semiconductor laser between ON and OFF according to image data so as to project the light image. In particular, in the case of the digital copying machine, the image data which is produced by reading the reflected light from the document to be copied, with an image reading sensor (for example, a CCD (charge coupled device) element), is input to the optical system including the semiconductor laser. Then, the light image corresponding to the image data is output. In the case of the printer, the image data from other processing devices such as a word processor and a personal computer is converted into a light image corresponding to the image data, and the light image is projected. For the conversion to the light image, not only a semiconductor laser, but also an LED (light emitting diode) element and a liquid crystal shutter, etc. are used. More specifically, laser light is usually used for a digital device, and lamp light is used for an analog device.

As described above, when the image forming operation of the image forming apparatus is started, the photoreceptor 1 is driven to rotate in the direction indicated by an arrow, and the surface of the photoreceptor 1 is uniformly charged to a predetermined potential of a specified polarity by the charging device. After charging, the light image is projected by the optical system (not shown), and then an electrostatic latent image corresponding to the light image is formed on the surface of the photoreceptor 1. The electrostatic latent image is developed in the next developing device 2 for artificially visualizing the latent image.

In the developing device 2 of this embodiment, a one-component developer (one-component toner) is used, and development is performed by selectively attracting the toner to the electrostatic latent image formed on the surface of the photoreceptor 1 by, for example, an electrostatic force.

The developed toner image on the surface of the photoreceptor 1 is electrostatically transferred to the transfer paper transported appropriately in synchronism with a rotation of the photoreceptor 1 by the transfer device disposed in the transfer region. The transfer is performed so as to transfer the toner image to the transfer paper by charging the back surface of the transfer paper in a polarity opposite to the polarity of the charged toner by the transfer device.

After the transfer, a part of the toner, which was not transferred, remains on the surface of the photoreceptor 1. The residual toner is removed from the surface of the photoreceptor 1 by the cleaning device. In order to reuse the toner, the charge is removed from the surface of the photoreceptor 1 by the charge removing device so that the surface of the photoreceptor 1 has a uniform potential, for example, a substantially zero potential.

Meanwhile, the transfer paper after the transfer is separated from the photoreceptor 1 and transported to the fixing device.

In this fixing device, the toner image on the transfer paper is melted, and pressed and fused to the transfer paper by pressing forces between the heat roller and the pressure roller. The transfer paper which has passed through the fixing device is output as transfer paper having an image formed thereon to the output tray or the like provided outside of the image forming apparatus.

Next, the following descriptions will explain the developing device 2 as a characteristic feature of this embodiment.

As illustrated in FIG. 2, the developing device 2 includes a rotatable development roller 21 and a toner supply roller 22 for supplying the toner T to the development roller 21, in a developer container 20 storing a one-component toner T (hereinafter referred to as the "toner T") such as a non-magnetic one-component toner.

The development roller 21 provided in the developer container 20 is arranged so that it partly appears outside of the developer container 20 and faces the photoreceptor 1. Moreover, in order to transport the toner T to the development region, the development roller 21 is rotated in a direction opposite to the photoreceptor 1. Meanwhile, the above-mentioned toner supply roller 22 is pressed against the development roller 21.

The operation of the developing device and an operation performed thereafter will be explained in detail below though some explanation overlaps the above explanation.

In the developing device 2, the toner T stored in a toner tank (hereinafter referred to as the "hopper" not shown) is transported in the vicinity of the development roller 21 in the developer container 20 by an agitator or screw (not shown).

As described above, the toner supply roller 22 is pressed against the development roller 21. The rotating direction of the toner supply roller 22 is the same as the rotating direction of the development roller 21. A voltage is being applied to the toner supply roller 22 by a supply bias power source 3. In general, the supply bias power source 3 applies the voltage so that the toner T is pushed toward the development roller 21. For instance, when a negative toner is used, a greater negative bias voltage is applied to the toner supply roller 22.

The toner T supplied to the development roller 21 by the toner supply roller 22 is transported to a contact position where a blade 30 as a toner layer thickness regulating member comes into contact with the development roller 21 with a rotation of the development roller 21. The toner T supplied to the development roller 21 is transported to a development region, i.e., to an opposing section facing the photoreceptor 1, while being regulated to have a predetermined amount of charge and thickness according to predetermined pressure and position settings of the blade 30, and moves into the development step.

Incidentally, a voltage is being applied to the blade 30 by a blade bias power source 4. For instance, if the toner is a negative toner, a greater negative bias voltage is usually applied to the blade 30 so that the toner T is pushed toward the development roller 21. However, in the case where the electrical withstand pressure of the toner T is low and influences the development bias, a bias voltage for achieving the same potential as the development roller 21 may be applied.

Undeveloped toner T on the development roller 21, which has not been used in the development step, returns to the developer container 20 of the developing device 2 with a rotation of the development roller 21. At this time, charges are removed from the undeveloped toner T by the charge removing device 5. Then, when the undeveloped toner T is pressed at the entrance of the toner supply roller 22, it is separated and collected for reuse. The charge removing device 5 is disposed after the development region but before the toner supply roller 22. In other words, the charge removing device 5 is located in the downstream side of the development region in the rotating direction of the development roller 21 but in the upstream side of a position where the toner supply roller 22 is pressed against the development roller 21.

On the other hand, as described above, the surface of the photoreceptor 1 was charged in a desired potential in advance by a charging device, for example, a corona charger or a contact roller charging device (not shown). A latent image potential is produced on the charged surf ace by an exposure device of an optical system (not shown) provided separately. The photoreceptor 1 is formed by applying an underlayer onto a conductive base body made of a metal or resin and then applying a charge generation layer (CGL) on the under layer. Moreover, a charge transport layer (CTL) composed mainly of polycarbonate is applied in the form of a thin film as the outermost layer of the photoreceptor 1.

The charged potential of the charged photoreceptor 1 is cancelled by carrier, i.e., charge, generated from the charge generation layer by the exposure, thereby forming the above-mentioned latent image potential (electrostatic potential).

An electrostatic latent image formed on the photoreceptor 1 is transported to a region facing the development roller 21, i.e., the development region, with a rotation of the photoreceptor 1. In the development region, the conductive development roller 21 is pressed against the photoreceptor 1. At least the surface of the development roller 21 is made of an elastic member. According to the above-mentioned step, the toner T which was controlled to have a desired amount of charge and a desired layer thickness in advance moves to the photoreceptor 1 in accordance with a latent image pattern, and develops the latent image into a visible toner image.

Thereafter, as described above, after developing the latent image potential of the photoreceptor 1 into a visible toner image by the toner T, the photoreceptor 1 rotates, thereby transporting the visible toner image to a transfer region where the transfer device (not shown) is positioned. A transfer paper fed by the paper feeding device (not shown) is transported to the transfer region and comes into contact with the toner image on the photoreceptor 1 in a synchronized manner.

Examples of the transfer device include a charger type device provided with a high voltage power source, and a contact roller type device. With either of the means, the transfer device applies a voltage of a polarity for moving the toner T from the photoreceptor 1 to the transfer paper, and transfers the toner image on the photoreceptor 1 to the transfer paper. After the toner image is transferred to the transfer paper, the transfer paper is transported so that the toner image is usually fused and fixed onto the transfer paper by the fixing device, and then output.

On the other hand, the untransferred toner T which resides on the photoreceptor 1 after passing through the transfer region is removed from the photoreceptor 1 by the cleaning device (not shown). Thereafter, the potential is refreshed by a charge removing device such as an optical charge removing lamp (not shown) for removing the residual charge. Then, the process moves to the next step.

The following descriptions will explain in detail the respective sections of the developing device 2.

The development roller 21 is formed by coating a core as an axis made of a metal or low-resistant resin with an elastic member having a relative permittivity of about 10. Suitable materials for the elastic member on the surface of the development roller 21 are a diffused-type resistance adjusting resin based material and an electric resistance adjusting resin based material. The diffused-type resistance adjusting resin based material is prepared by dispersing and mixing one or more than one kind of electric resistance adjusting material such as conductive fine particles, carbon and $TiO_2$ into a resin selected from, for example, ethylene propylene dien rubber (hereinafter referred to as "EPDM") , urethane, silicone, nitryl butadiene rubber, chloroprene rubber, styrene butadiene rubber, and butadiene rubber. The electric resistance adjusting resin based material is prepared by using, as the above-mentioned resin, one or more than one kind of ionic conductive material, for example, inorganic ionic conductive materials such as sodium perchlorate, calcium perchlorate and sodium chloride, and organic ionic conductive materials such as denatured aliphatic dimethylethyl ammonium ethosulfate, stearyl ammonium acetate, lauryl ammonium acetate and octadecyl trimethyl ammonium perchlorate.

Incidentally, for the development roller 21, in order to obtain a further elasticity, a blowing agent may be used in the blowing and mixing step. Examples of suitable blowing agents include silicon based surface active agents such as poly dialkyl siloxane, and polysiloxane-polyalkylene oxide block copolymer.

For the toner supply roller 22, a material similar to the development roller 21 is used. It is possible to adjust the electrical resistance by using a resistance adjusting material similar to the development roller 21. Moreover, in order to further increase the elasticity, the toner supply roller 22 is formed from a foamed material and a greater amount of the blowing agent than for the development roller 21.

A carbon black used as the electric resistance adjusting material for the development roller 21 and toner supply roller 22 has a nitrogen adsorption specific surface area in the range of 20 $m^2/g$ to 130 $m^2/g$, and a DBP (dibutyl phthalate) oil absorption in the range of 60 ml/g to 120 ml/g. For instance, 0.5 part by weight to 15 parts by weight of ISAF (intermediate super abrasion furnace), HAF (high abrasion furnace), GPF (general purpose furnace), SRF (semi reinforcing furnace), etc. based on 100 parts by weight of polyurethane is mixed. However, in some case, around 70 parts by weight of carbon black is mixed.

As the charge removing device 5, a corona charger, contact separation rotary member, etc, have been created. In the case where a plate-like elastic member is used as the charge removing member, nylon, PET (polyethylene terephthalate), PTFE (polytetrafluoroethylene)-containing resin, polyurethane and the like are used as a base member, and carbon is used as the electric resistance adjusting material to achieve an appropriate electric resistance, and charge is removed by the electric supply from a charge removing bias power source 6.

The carbon black used in this case is a carbon black having a nitrogen adsorption specific surface area in the range of 20 $m^2/g$ to 130 $m^2/g$, and a DBP oil absorption in the range of 60 ml/g to 120 ml/g. For instance, not less than 10 parts by weight of furnace such as ISAF, HAF, GPF, and SRF, or channel black based on 100 parts by weight of polyurethane is mixed. However, in some case, around 70 parts by weight of carbon black is mixed. This proportion is used not only for polyurethane, but also for nylon, PET and other resins.

For the toner T as a one-component developer, a negatively charged toner is used. This toner has an average particle diameter in the range of 2 to 20 $\mu$m, more preferably 5 to 10 $\mu$m, and is composed of 80 to 90 parts by weight of styrene-acrylic copolymer, 5 to 10 parts by weight of carbon black, 0.5 to 1.5 parts by weight of $SiO_2$ as an additive, and 0 to 5 parts by weight of charge control agent. However, even when a positively charged toner is used, no problem occurs, and it is of course possible to apply such a composition not only to a black toner used for monochrome copying machines and printers, but also to a color toner used for color copying machines and printers.

Besides, non-magnetic one-component toner T is not necessarily limited to the above-mentioned composition. Namely, the composition described hereinbelow can be used for this embodiment.

More specifically, for the thermoplastic resin as the main resin, it is possible to use polystyrene, polyethylene, polyester, low molecular-weight polypropylene, epoxy, polyamide, polyvinyl butyral, etc. as well as styrene-acrylic copolymer.

As the colorants, furnace black, nigrosine dyes and metal-containing dyes as well as carbon black can be used for black toner. As the colorants for color toner, there are benzidine yellow pigment, phonon yellow, acetoacetanilide based insoluble azo pigment, monoazo pigment, azomethine pigment, etc. for yellow toner. For magenta toner, it is possible to use xanthene magenta dye, phosphotungstomolybdic acid lake pigment, anthraquinone dye, color material composed of xanthene dye and organic carboxylic acid, thioindigo, naphthol based insoluble azo pigment, etc. For cyan toner, it is possible to use copper phthalocyanine pigment, etc.

As the additive, it is possible to use colloidal silica, titanium oxide, alumina, zinc stearate, polyvinylidene fluoride, or mixtures thereof as well as $SiO_2$.

As the charge control agent, azo based metallized dye, organic acid metal complex salt, chlorinated paraffin wax, etc. can be used for negatively charged toner, and nigrosine dye, fatty acid metal salt, amine, quaternary ammonium salt, etc. can be used for positively charged toner.

The blade 30 as the toner layer thickness regulating member is a metal plate with a thickness ranging from 0.05 to 0.2 mm, and comes into contact with the development roller 21 in the vicinity of the tip thereof.

Figure 1:
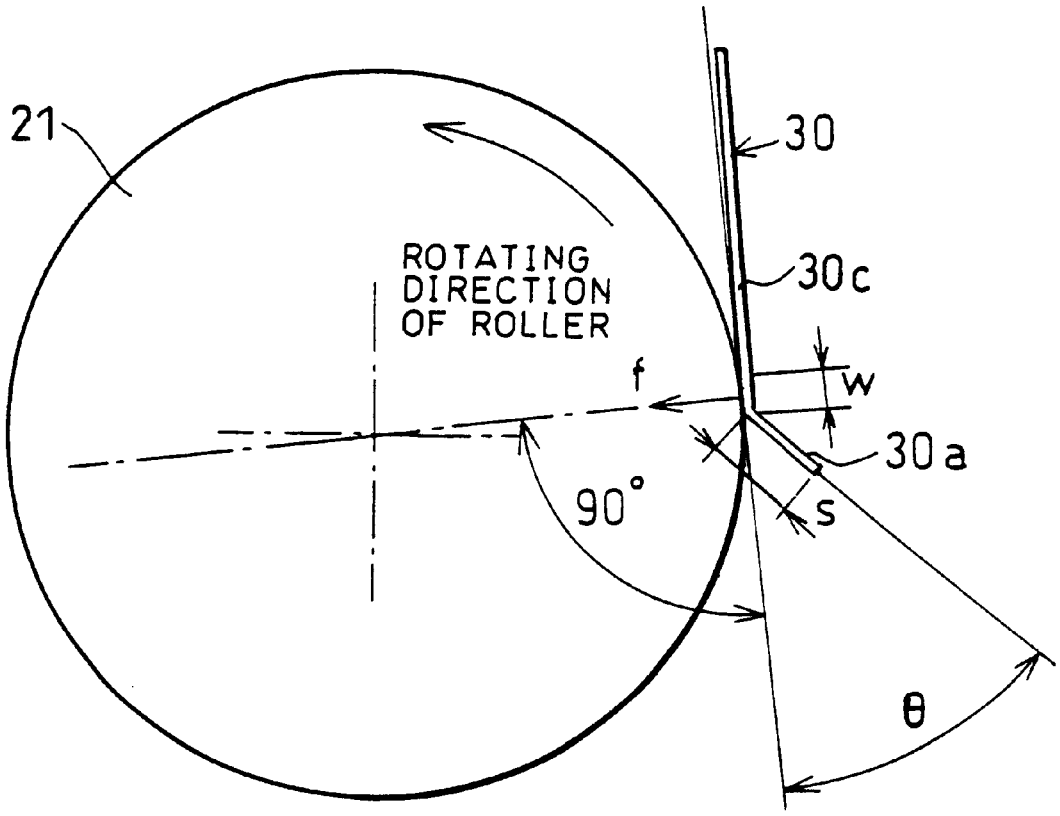
FIG. 1 is a schematic structural view showing the configuration of a blade of a developing device using a one-component developer according to one embodiment of the present invention, and a state in which the blade is in contact with a development roller.

The base of the blade 30 is fixed to the developing device 2, and the tip of the blade 30 is a free end. The blade 30 includes a plate-like blade main body 30*c*, and an inclined section 30*a* extending from a section (contact section) of the blade main body 30*c*, which is in contact with the development roller 21. The blade main body 30*c* is mounted so that the contact section of the blade main body 30*c* is pushed by the elasticity of the blade 30 and comes into contact with the outer surface of the development roller 21 along a rotation axis direction of the development roller 21. As a result, the contact section of the blade main body 30*c* is in plane contact with the development roller 21. In this case, as shown in FIG. 1, the blade 30 is mounted so that the blade main body 30*c* is shifted slightly (at an angle of around 20° to 5°) in, for example, a clockwise direction with the contact section as a fulcrum, with respect to a direction tangent to the contact section. It is therefore possible to stabilize the plane contact of the contact section which comes into contact with the elastic member on the surface of the development roller 21. When the blade 30 is deformed elastically, it regulates the toner layer on the development roller 21 to have a predetermined amount of charges and thickness with a predetermined pressure. The inclined section 30*a* is a plane tilted with respect to the blade main body 30*c*, at a later described angle in a direction of going away from the development roller 21.

As the material for the blade 30, a material having elasticity (spring property) is usually used. For instance, it is possible to use spring steel such as SUP, stainless steel such as SUS301, SUS304, SUS420J2, SUS631, and copper alloy such as C1700, C1720, C5210, and C7701.

Next, the blade 30 will be explained in great detail.

As illustrated in FIG. 2, the photoreceptor 1 is a negatively charged photoreceptor having a diameter of 65 mm, a conductive base member earthen and a surface potential charged to −550 V. The photoreceptor 1 is rotated in the direction indicated by an arrow (for example, in a clockwise direction) at a circumferential speed of 190 mm/s.

On the other hand, the development roller 21 with a diameter of 34 mm is rotated in the direction indicated by an arrow (for example, in a counterclockwise direction) at a circumferential speed of 285 mm/s. A development bias voltage of −450 V is applied from a development bias power source 7 to the development roller 21 through a stainless shaft with a diameter of 18 mm. The development roller 21 is pressed against the photoreceptor 1 with the toner layer therebetween so that the development nip width is about 2 mm.

The material of the development roller 21 is a conductive urethan rubber with a conductive agent such as carbon black added thereto, a volume resistivity of about $10^6$ Ωcm, an Asker C hardness in the range of 60 to 70 degrees according to SRIS0101 (Standard of Society of Rubber Industry, Japan) and a center line average roughness Ra of about 1.0 μm according to JIS B0601 (surface roughness).

The toner supply roller 22 with a diameter of 20 mm comes into contact with the development roller 21 at a contact depth of 0.5 mm, and is rotated in the direction indicated by an arrow (for example, in a counterclockwise direction) at a circumferential speed of 170 mm/s. A supply bias voltage of −550 V is applied from the supply bias power source 3 to the toner supply roller 22 through a stainless shaft with a diameter of 8 mm.

The material of the toner supply roller 22 is a conductive urethane foam with a specific insulation resistance of about $10^5$ Ωcm and a cell density of about 3 to 4 cells/mm. The toner supply roller 22 also performs the functions of agitating toner and removing toner after development.

After the non-magnetic one-component toner T which was negatively charged in advance by the toner supply roller 22 is applied to the surface of the development roller 21, a blade bias voltage of −550 V is applied by the blade bias power source 4. The toner deposit and the charge of toner are regulated to 0.6 to 0.8 mg/cm$^2$ and −10 to −20 μC/g, respectively, by the blade 30 made of a 0.1-mm thick stainless plate having a cantilever spring structure with a free end located on the upstream side in a rotating direction of the development roller 21, thereby performing a contact reversal development.

Here, the toner deposit (the amount of carried toner) is the amount (=m/a) of toner per unit area derived from the toner mass carried on the surface area a of the development roller 21. Besides, the amount of charge of toner is the amount of charge of toner (=q/m) per unit mass derived from the amount of charge q (μC/g) carried by the toner T with a mass of m (mg).

Although it is not shown in FIG. 2, a seal for preventing a leakage of toner T is provided at both ends of the development roller 21 and blade 30. A polyurethane foam with a thickness of 2 mm and a width of 12 mm is provided between the frame of the developing device 2 and the development roller 21 and between the frame and the back surface of the blade 30.

EXAMPLES

Example 1

The following descriptions will explain the results of studying the blade 30 as a toner layer thickness regulating member having the above-mentioned structure.

As illustrated in FIG. 2, the blade 30 is made of a metal plate which has a spring property and is placed along a longitudinal direction of the development roller 21. As described above, the base of the blade 30 is fixed to the developing device 2, while the tip thereof hangs down as a free end. The blade 30 includes the blade main body 30*c* which is in plane contact with the development roller 21, and the inclined section 30*a*. An end section (contact section) of the inclined section 30*a*, which is in contact with the development roller 21, is slightly slanted at an angle in a direction so that the distance between the development roller 21 and the inclined section 30*a* increases from the contact section toward the tip thereof. Namely, the blade 30 has a substantially L-shaped cross section.

As illustrated in FIG. 1, the blade 30 presses the surface of the development roller 21 with a predetermined contact pressure f of about 20 gf/cm. As a result, the blade 30 charges the toner T carried between the blade 30 and the development roller 21 in a nip width w determined by the contact pressure f to the development roller 21 and the diameter and elasticity of the development roller 21, thereby forming a thin layer of the toner T. In this example, the nip width w is about 1 mm.

In this example, as shown in FIG. 1, by denoting the flare angle formed by a line tangent to the contact surface (contact section) of the development roller 21 with the blade 30 and the inclined section 30*a* of the blade 30 as the tilt angle θ and the length of the inclined section 30*a* as the inclined section length S, the optimum conditions for the tilt angle θ were examined.

For the optimum conditions, the influence of the tilt angle θ on the toner deposit (m/a), i.e., the toner weight per unit area on the development roller 21, was measured when toner T with an average particle diameter of 7 μm produced by using polyester as a main resin was used in the developing device 2. More specifically, in order to clarify the influence of the deterioration of the toner T with time, the toner deposit (m/a) on the development roller 21 was measured at the beginning and after idle running the device continuously for 10 hours.

As the blade 30, a material, which was prepared by tempering SUS304-CSP to 3/4H and shaped into a plate with a thickness of 0.1 mm and an inclined section length S of 0.3 mm (300 μm), was used.

Figure 3:
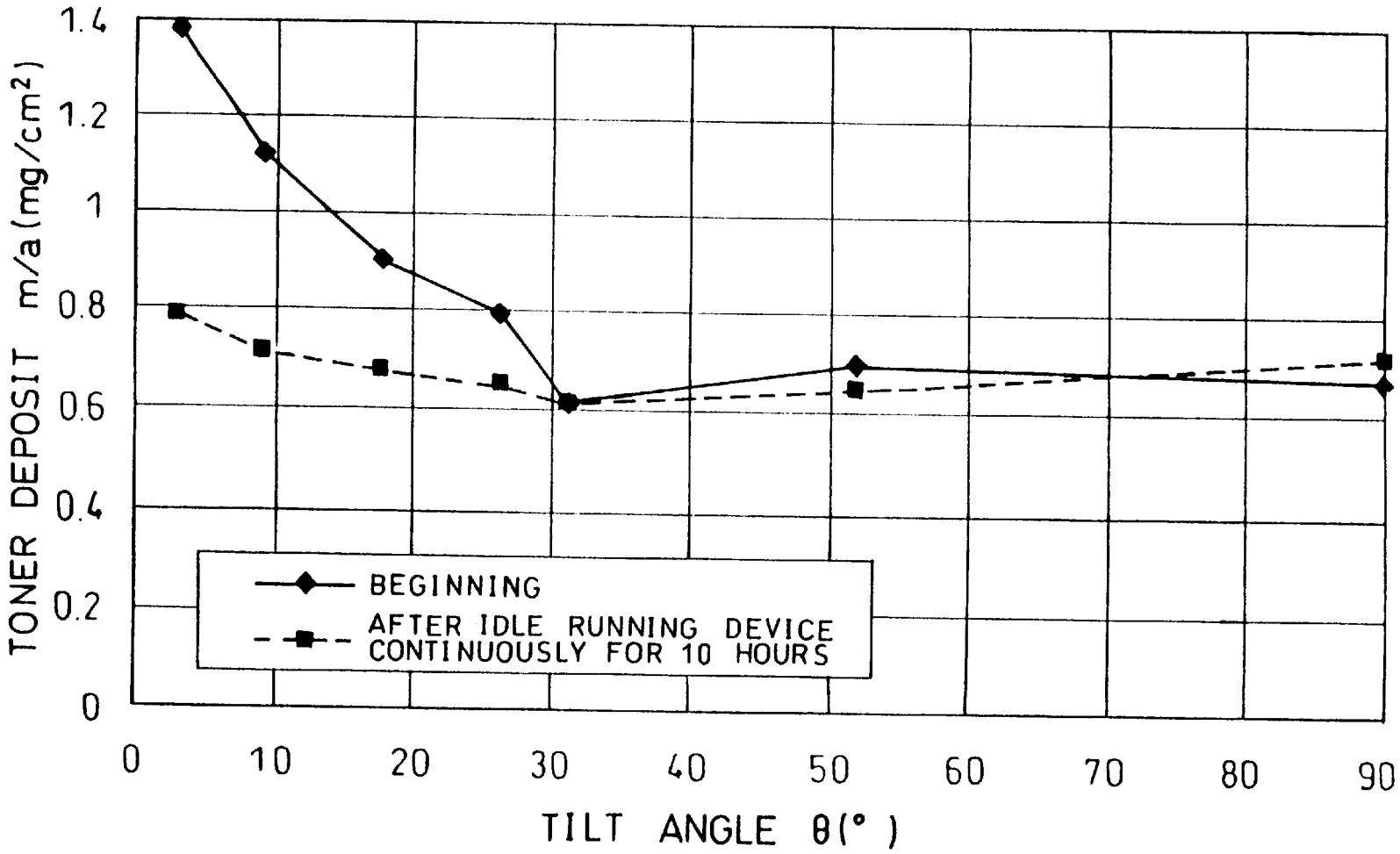
FIG. 3 is a graph showing the relationship between the tilt angle θ of the blade and the toner deposit (m/a) at the beginning, and after the developing device was idled continuously for 10 hours.

As a result, it was found as shown in FIG. 3 that in a region where the tilt angle θ was smaller than 30°, the toner deposit (m/a) was decreased due to the deterioration of the flowability caused by the continuous idle running. However, when the tilt angle θ was within the range between 30° and 90°, such a decrease in the toner deposit (m/a) was not recognized. Thus, it was found that it is possible to form an extremely stable toner layer even when the toner T deteriorates with time.

Next, the influence of the tilt angle θ on the toner deposit (m/a) on the development roller 21 was studied by varying the tilt angle θ within a range between 10° and 90° when the toner T which had an average particle diameter of 7 μm and was prepared by using polyester as a main resin was used.

More specifically, the inclined section length S of the inclined section 30*a* of the blade 30 was set to three levels of 30 μm, 500 μm, and 1000 μm, and the relationship between the toner deposit (m/a) and the tilt angle θ was examined.

Figure 4:
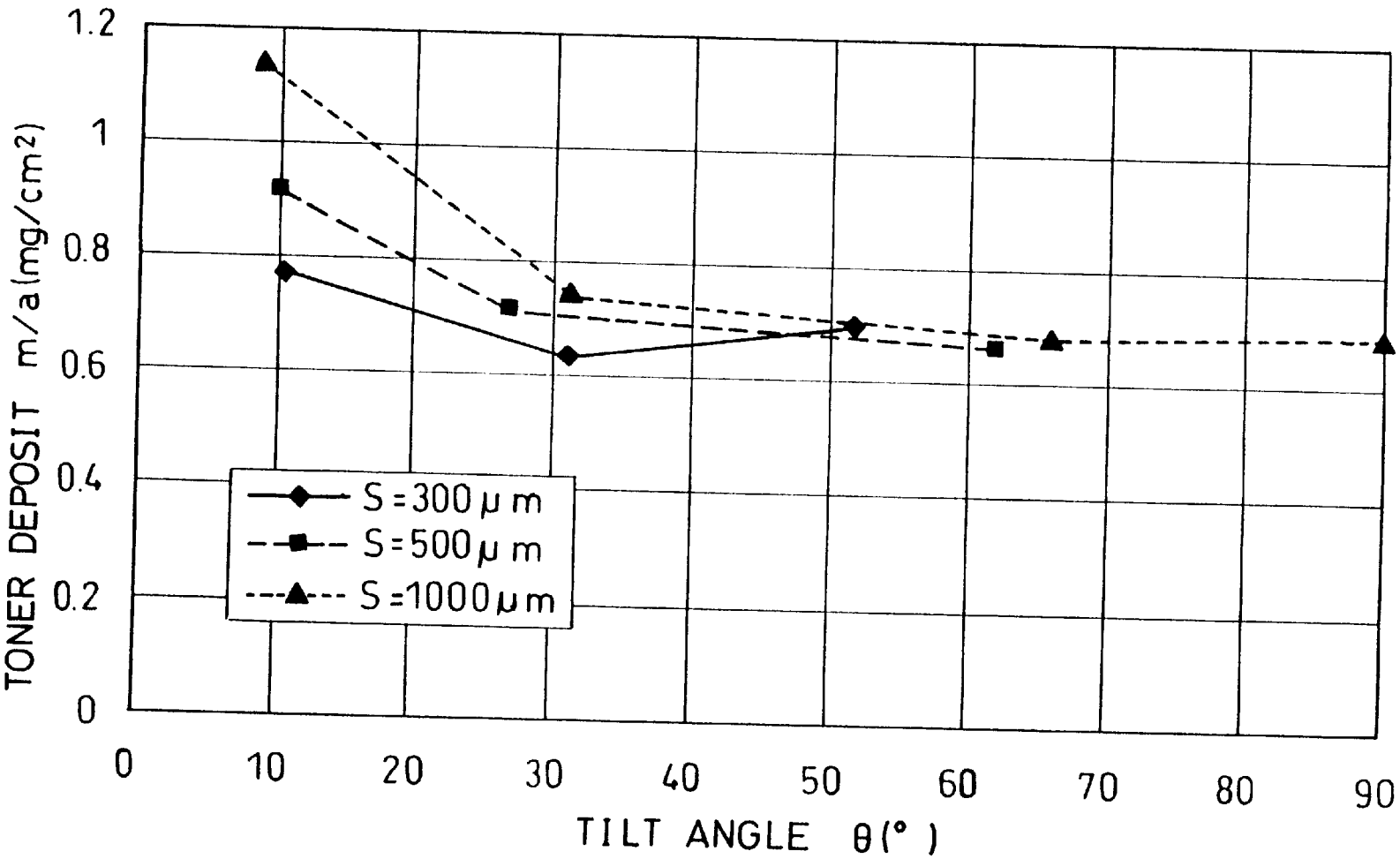
FIG. 4 is a graph showing the relationship between the tilt angle θ of the blade and the toner deposit (m/a) when the inclined section length S was varied.

As a result, it was found as shown in FIG. 4 that the difference in the toner deposit due to the difference in the inclined section length S decreased with an increase in the tilt angle θ and that a desired toner deposit within the range between 0.6 and 0.8 mg/cm$^2$ was obtained with any of the three levels when the tilt angle θ was not smaller than 30°.

This result shows not only the influence of the inclined section length S on the toner deposit (m/a) is reduced by setting the tilt angle θ within the range between 30° and 90°, but also the influence of the tilt angle θ on the toner deposit (m/a) is reduced.

The influence of the inclined section length S was examined in great detail.

Specifically, the influence of the inclined section length S on the toner deposit (m/a) was examined for the blades 30, each with a tilt angle θ of 10°, 30° or 60°.

Figure 5:
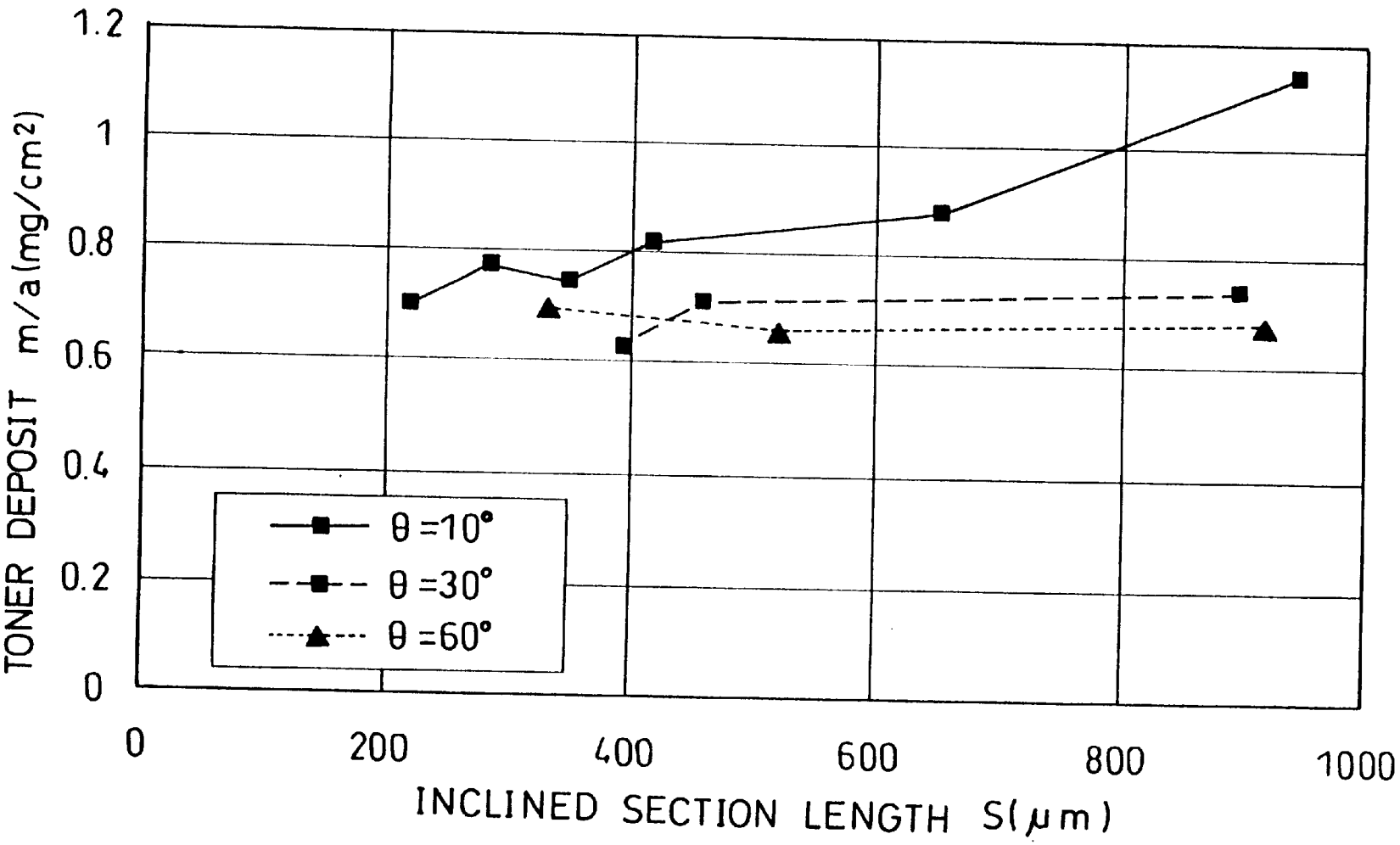
FIG. 5 is a graph showing the relationship between the inclined section length S of the blade and the toner deposit (m/a) when the tilt angle θ was varied.

As a result, it was found as shown in FIG. 5 that when the tilt angle θ was 10°, the toner deposit (m/a) tended to increase as the inclined section length S became longer. In order to obtain a desired toner deposit within the range between 0.6 and 0.8 mg/cm$^2$, the inclined section length S must be 300 μm±100 μm. It is therefore necessary to strictly set the tolerance for the fabrication of the blade 30.

However, it was found that, when the tilt angle θ was not less than 30°, a desired toner deposit within the range between 0.6 and 0.8 mg/cm$^2$ could be obtained irrespective of the value of the inclined section length S.

Namely, it was found that the dimensional tolerance of the inclined section 30*a* of the blade 30 was relaxed by setting the tilt angle θ to satisfy 30°≦θ≦90°.

Thus, the blade 30 of this embodiment is in plane contact with the development roller 21. Moreover, in order to form a flare at the inflow section of toner T between the blade 30 and the development roller 21, the inclined section 30*a* is formed at an end section of the blade 30. When the flare angle between the blade 30 having the flare and a line tangent to the development roller 21 at the contact section is denoted by the tilt angle θ, 30°≦θ≦90°.

Namely, the present inventors found that the flare angle at the inflow section of toner T which is determined by considering the elastic deformation of the development roller 21 was dominant for obtaining a desired toner deposit (m/a). Moreover, the present inventors performed experiments to examine a flare angle capable of forming a toner layer with an extremely stable toner deposit (m/a) in relation with the deterioration with time such as the change in the flowability of the toner T.

As a result, it was possible to provide the blade 30 of the developing device 2 capable of forming a toner layer with an extremely stable toner deposit (m/a) irrespective of the deterioration of the toner T with time such as the change in the flowability of the toner T by setting the tilt angle θ within 30°≦θ≦90° so as to optimize the flare angle at the inflow section of toner T formed between the blade 30 and the development roller 21.

Furthermore, it was found that the influence of the change in the inclined section length S of the inclined section 30*a* on the toner deposit (m/a) when the blade 30 comes into contact with the development roller 21 could be reduced by satisfying 30°≦θ≦90°.

As a result, it was possible to provide the blade 30 of the developing device 2 which can relax the dimensional tolerance of the inclined section 30*a* and can be fabricated easily at a low cost.

Example 2

In this example, the blade 30 with a plate thickness of 0.1 mm was formed from a material C5210 by mechanical bending so that the inclined section length S was 1 mm and the tilt angle θ was within the range between 5° and 90°.

The unevenness of the toner layer on the development roller 21 was observed. The results are shown in Table 1.

TABLE 1

| TILT ANGLE θ (°) | UNEVENNESS |
|---|---|
| 5 | None |
| 10 | None |
| 30 | None |
| 60 | None |

TABLE 1-continued

| TILT ANGLE θ (°) | UNEVENNESS |
|---|---|
| 70 | Passage with a width of 10 mm |
| 90 | Passage with a width of 15 to 20 mm |

Namely, when the tilt angle θ was 70° or more, distortion occurred due to the residual stress after the process of bending, and the blade 30 had distortion in a width of 10 to 20 mm through the entire width of 300 mm. The distortion was not eliminated even when the blade 30 was fixed to the developing device 2. It is deemed that variations in the toner deposit of the toner layer on the developing roller 21 occurred because of the deterioration of the straightness of the contact section of the blade 30 with the development roller 21.

On the other hand, when the tilt angle was 60° or less, slight distortion due to bending occurred. However, when this blade 30 was applied to an actual developing device 2, a satisfactory toner layer having almost no evenness was obtained.

Hence, the blade 30 of this embodiment is formed by a metal thin plate, and the inclined section 30*a* of the blade 30 is formed by mechanical bending.

Therefore, the blade 30 of the developing device 2 can be fabricated easily at a low lost.

Moreover, when the angle of flare formed between the blade 30 and a line tangent to the development roller 21 is denoted by the tilt angle θ, it is preferred that the blade 30 of this embodiment satisfies 30≦θ≦60°.

More specifically, according to a prior art of bringing the bent portion of a blade having a substantially L-shaped cross section into contact with the development roller 21, distortion occurs due to the residual stress after bending. Thus, it is difficult to ensure the straightness of the contact section of the blade with the development roller 21. This causes a problem that the toner layer has unevenness corresponding to the unevenness on the surface of the blade.

In contrast, in this embodiment, the blade 30 is in plane contact with the development roller 21.

Namely, although the inclined section 30*a* is formed at an end section of the blade 30, the contact portion (contact section) of the blade 30 with the development roller 21 is in plane contact with the development roller 21.

It is therefore possible to limit the formation of unevenness of the toner layer corresponding to the unevenness of the surface of the blade 30 compared with a method of bringing the corner of the bent section into contact with the development roller 21.

On the other hand, the formation of the inclined section 30*a* and the plane contact of the blade 30 with the development roller 21 are not always sufficient for preventing unevenness corresponding to the unevenness of the surface of the blade 30 from being produced on the toner layer on the development roller 21.

The present inventors found that the unevenness of the toner layer is influenced by the flare angle at the inf low section of the toner T which is determined by considering the elastic deformation of the development roller 21, and examined the relationship between the flare angle and the unevenness of the toner layer by experiments so as to prevent unevenness corresponding to the unevenness of the surface of the blade 30 from being produced on the toner layer on the development roller 21.

As a result, it was found as mentioned above that the influence of the residual stress applied to the bent section was reduced, the unevenness of the toner layer was decreased and an image of a uniform density was obtained by arranging the tilt angle θ to satisfy $30° \leqq \theta \leqq 60°$.

Hence, it is possible to provide the blade 30 of the developing device 2 capable of forming a uniform toner layer along an axis direction of the development roller 21 while maintaining the straightness of the blade 30.

Example 3

In this example, as a material for the blade 30, a material prepared by tempering SUS301-CSP specified by JIS G4313 (spring-use stainless steel strip) to 3/4H, H or EH, or tempering SUS304-CSP to 3/4H or H was used.

Compared with the case where spring-use phosphor bronze typified by, for example, C5210, or SUS301 or SUS304 to which the tempering process was not applied was used, when the above-mentioned material was used, the inclined section 30*a* with better dimensional precision was obtained by mechanical bending, the straightness of the bent portion (contact section) of the blade 30 was improved, and a satisfactory toner layer was formed over the entire width of the development roller 21 along the axis direction.

Figure 6:
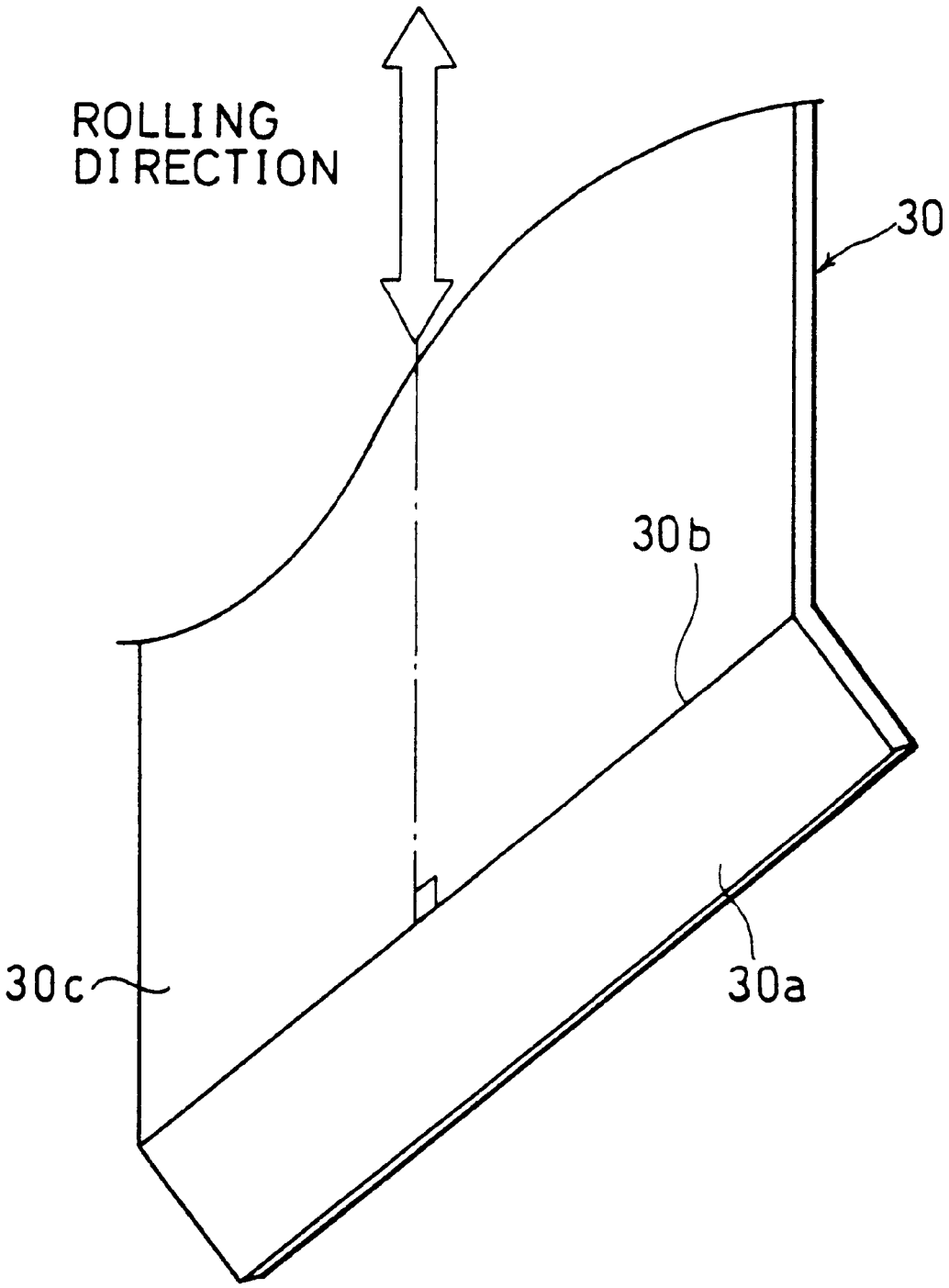
FIG. 6 is a depiction showing the relationship between a rolling direction and a bend direction of a thin plate of the blade.

Moreover, in this example, as illustrated in FIG. 6, when forming the inclined section 30*a* of the blade 30 by mechanical bending, the blade 30 was bent so that it had a bend line 30*b* in a direction perpendicular to the rolling direction of the thin plate material.

As a result, compared with a case where bending was performed so that the blade had a bend line in a direction parallel to the rolling direction, the straightness of the contact section of the blade 30 along a direction parallel to the bend line 30*b* was improved, and a satisfactory toner layer was formed over the entire width of the development roller 21 along the axis direction.

Additionally, by performing TA (tension annealing), i.e., annealing, to the rolled material used for the blade 30 before bending, the straightness of the contact section of the blade 30 with the development roller 21 was improved compared with a material to which annealing was not performed, and a satisfactory toner layer was formed over the entire width of the development roller 21 along the axis direction.

Thus, the blade 30 of this example is made of a material prepared by tempering SUS301-CSP specified by JIS G4313 (spring-use stainless steel strip) to 3/4H, H or EH, or tempering SUS304-CSP to 3/4H or H.

As a result, the straightness of the contact plane (contact section) of the blade 30 with the development roller 21 is ensured, and a satisfactory toner layer can be formed over the entire width of the development roller 21 along the axis direction.

Moreover, according to the blade 30 of this example, by bending the blade 30 to have the bend line 30*b* in a direction perpendicular to the rolling direction of the thin plate material during the fabrication of the blade 30, the rolling direction of the blade 30 during bending is specified. Consequently, it is possible to minimize the influence of distortion which was caused during rolling and present originally in the material of the blade 30 on the straightness of the contact plane of the blade 30 with the development roller 21.

As a result, the straightness of the contact plane of the blade 30 with the development roller 21 is ensured, and a satisfactory toner layer can be formed over the entire width of the development roller 21 along the axis direction.

Furthermore, the blade 30 of this example was annealed before bending. By annealing the blade material before bending, it is possible to eliminate the distortion caused during the rolling of the material, and ensure the straightness of the contact plane of the blade 30 with the development roller 21. It is therefore possible to form a satisfactory toner layer over the entire width of the development roller 21 along the axis direction.

Moreover, when the blade 30 of this embodiment is used in the developing device 2, the following effects are obtained. Specifically, in the developing device 2, since the margin for error in setting the amount of toner deposit is increased, the blade 30 can be easily mounted/fixed to the developer container 20. It is thus possible to relax the requirement for the precision of the developer container 20 to which the blade 30 is to be mounted (the precision of a positioning member in fixing the blade 30).

Namely, with a prior art, when the developer container made of a resin is made thin to reduce the weight and cost, it is likely to warp due to a decrease in the rigidity. As a result, drawbacks such as deterioration of precision occur.

However, with the use of the blade 30, it is possible use the developer container 20 whose thickness is reduced (for example, the thickness of the resin at the mount section was reduced to 1.5 mm to 2.0 mm from a conventional thickness of 3 mm), thereby achieving a reduction in the weight and cost of the developing device 20. For the same reason, the requirement for the precision of the diameter of the development roller 21 can be relaxed (the tolerance for the development roller 21 of a diameter of 34 mm is ±0.08 mm according to a prior art, but it can be relaxed to ±0.1 mm to ±0.2 mm in this embodiment). Hence, the fabrication cost of the development roller 21 can also be reduced.

In these embodiment and examples, as described above, the development roller 21 is an elastic roller produced by covering an axis as a core made of a metal or low-resistant resin with an elastic member of a relative permittivity of around 10. However, the development roller 21 is not necessarily limited to such an elastic roller. Namely, any roller which carries the toner T on the surface thereof and visualizes a latent image on the photoreceptor 1 can be used as the development roller 21. For instance, the present invention is applicable to a structure formed by a driving roller and a thin film sleeve which is made of a f lexible resin, metal or complex thereof with a thickness of 0.05 to 0.25 mm and wound around the driving roller. Besides, the development roller 21 may be a rigid roller made of a resin, metal or complex thereof.

Moreover, the above-mentioned embodiment and examples employ a so-called contact developing method in which development is performed by pressing the photoreceptor 1 and development roller 2 against each other. However, the present invention is not necessarily limited to this method. Needless to say, the present invention is applicable to a so-called non-contact developing method in which the photoreceptor 1 and development roller 21 are separated from each other by a predetermined space at a region where they face each other and development is performed.

Furthermore, the toner supply roller 22 can be separated from the development roller 21 or eliminated by optimizing the configuration of the developer container 20 and controlling the toner flow path and toner pressure.

Additionally, in the above-mentioned embodiment and examples, the blade 30 made of a metal thin plate is explained. However, the blade 30 is not necessarily limited to such a material. Namely, a resin can be used as a material for the blade 30 if the resin satisfies the configuration of the invention of claims 1 and 9. Besides, it is possible to use a resin, metal or complex thereof for the blade 30 if the contact section of the blade 30 with the development roller 21 satisfies claims 1 and 9.

In addition, as the method of forming an inclined plane of the blade 30 made of a resin, metal or complex thereof, it is possible to use so-called mechanical removal such as cutting and polishing, and fabrication.

Figure 7:
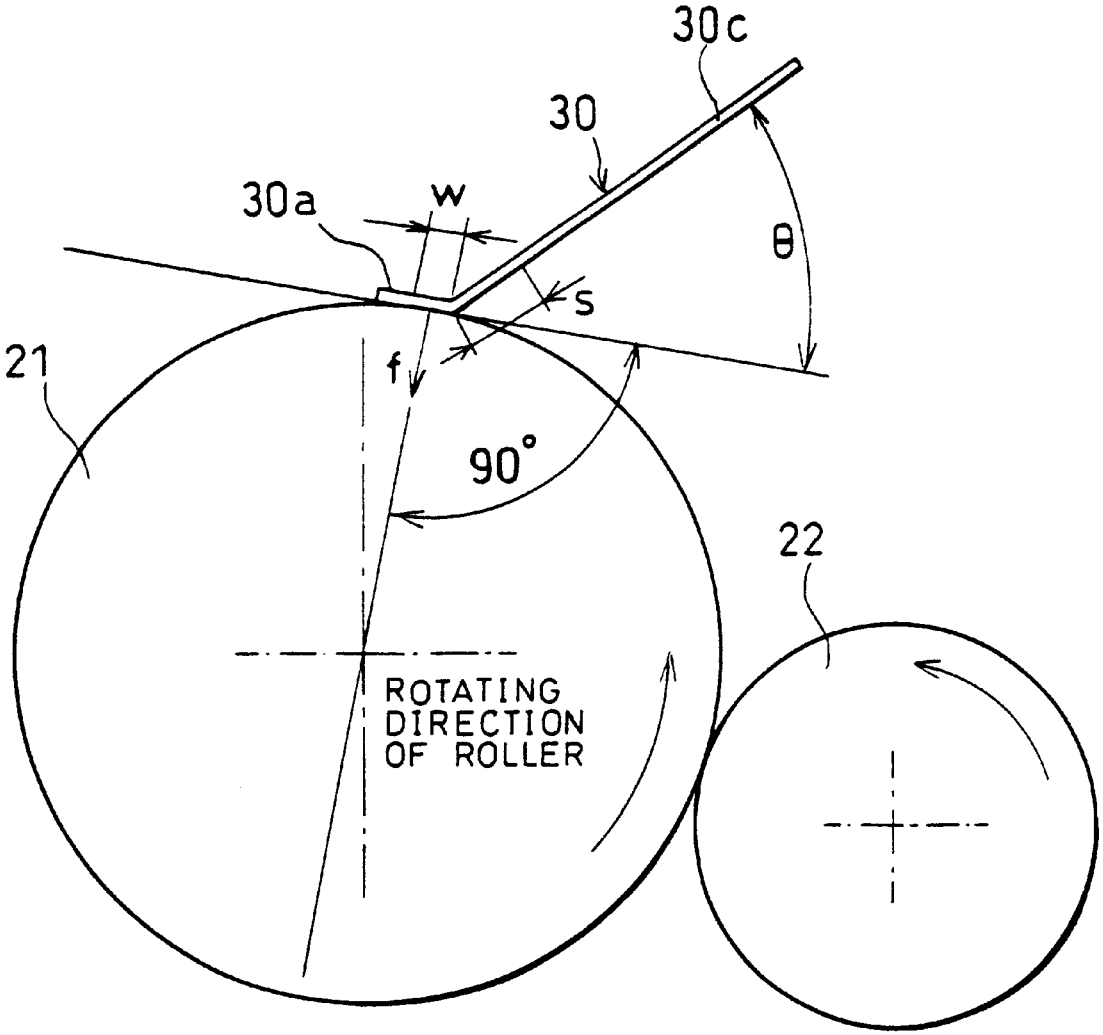
FIG. 7 is a schematic structural view showing the configuration of a blade of another embodiment of the present invention, and a state in which the blade is in contact with a development roller.

Besides, in the above-mentioned embodiment and examples, the free end of the blade 30 is positioned on the upstream side in a moving direction of the development roller 21 compared with the fixed end thereof. However, the blade 30 is not necessarily limited to this positional arrangement. For instance, the free end of the blade 30 can be positioned on the downstream side in the moving direction of the development roller 21 compared with the fixed end as shown in FIG. 7 if the blade 30 satisfies claims 1 and 9.

As described above, a first blade of a developing device using a one-component developer according to the present invention is a blade of a developing device using a one-component developer, which is pressed against the surface of a development roller that faces a photoreceptor, carries the one-component developer on the surface thereof and rotates so as to develop an electrostatic latent image on the photoreceptor with the one-component developer, and forms a thin layer of one-component developer on the surface of the development roller, wherein the blade is in plane contact with the development roller and includes an inclined section at an end thereof so as to form a flare at an inflow section of the one-component developer between the blade and development roller, and, when a flare angle formed between a line tangent to the development roller and the blade having the flare is denoted by a tilt angle $\theta$, $30° \leqq \theta \leqq 90°$.

According to the above invention, the blade is in plane contact with the development roller. Moreover, the inclined section is formed at an end of the blade so as to form a flare at the inflow section of the one-component developer between the blade and development roller. Moreover, when a flare angle formed between a line tangent to the development roller and the blade having the flare is denoted by a tilt angle $\theta$, $30° \leqq \theta \leqq 90°$.

Namely, the present inventors found that the flare angle at the inflow section of the one-component developer which was determined by considering the elastic deformation of the development roller was dominant for obtaining a desired toner deposit, and performed experiments to find a flare angle capable of forming a developer layer with an extremely stable one-component developer deposit in relation with the deterioration of the one-component developer with time such as the change in the flowability of the one-component developer.

Consequently, as described above, by setting the tilt angle $\theta$ to satisfy $30° \leqq \theta \leqq 90°$, it is possible to optimize the flare angle at the inflow section of the one-component developer between the blade and the development roller, and provide the blade of a developing device which uses a one-component developer and forms a developer layer with an extremely stable one-component developer deposit even when the one-component developer deteriorates with time, for example, the flowability of the one-component developer changes.

Furthermore, it was found that the influence of the variation in the inclined section length of the inclined section on the toner (one-component developer) deposit when the blade comes into contact with the development roller could be reduced by satisfying $30° \leqq \theta \leqq 90°$.

As a result, it is possible to provide the blade of the developing device using a one-component developer, which can relax the dimensional tolerance of the inclined section and can be fabricated easily at a low cost.

A second blade of a developing device using a one-component developer according to the present invention is based on the first blade of the developing device using the one-component developer, wherein the blade is preferably made of a metal thin plate and includes an inclined section formed by mechanical bending.

According to this invention, the blade is made of a metal thin plate, and the inclined section of the blade is formed by mechanical bending.

Therefore, this blade can be fabricated easily at a low cost.

A third blade of a developing device using a one-component developer of the present invention is based on the second blade of the developing device using the one-component developer, wherein, when the flare angle formed between a line tangent to the development roller and the blade having the flare is denoted by a tilt angle $\theta$, the tilt angle $\theta$ is preferably $30° \leqq \theta \leqq 60°$.

Specifically, according to a prior art of bringing the bent portion of a blade having a substantially L-shaped cross section into contact with the development roller, distortion occurs due to the residual stress after bending. Therefore, it is dif ficult to ensure the straightness of the contact section of the blade with the development roller. This causes a problem that the developer layer has unevenness corresponding to the unevenness on the surface of the blade.

However, according to the present invention, the blade is in plane contact with the development roller. More specifically, although the inclined section is formed at an end of the blade, the contact portion (contact section) of the blade is in plane contact with the development roller.

It is therefore possible to limit the formation of unevenness of the developer layer corresponding to the unevenness of the surface of the blade compared with a method of bringing the corner of the bent section into contact with the development roller.

On the other hand, the formation of the inclined section and the plane contact of the blade with the development roller are not always sufficient for preventing unevenness corresponding to the unevenness of the surface of the blade from being produced on the developer layer on the development roller.

Thus, in order to prevent unevenness corresponding to the unevenness of the surface of the blade from being produced on the developer layer on the development roller, the present inventors found that the unevenness of the developer layer is influenced by the flare angle at the inflow section of the one-component developer determined by considering the elastic deformation of the development roller, and performed experiments to examine the relationship between the flare angle and the unevenness of the developer layer.

As a result, it was found as described above that the inf luence of the residual stress applied to the bent section was reduced, the unevenness of the developer layer was decreased and an image of a uniform density was obtained by arranging the tilt angle $\theta$ to satisfy $30° \leqq \theta \leqq 60°$.

Hence, it is possible to provide the blade of the developing device using the one-component developer, which is capable of forming a uniform developer layer along an axis direction of the development roller while maintaining the straightness of the blade.

A fourth blade of a developing device using a one-component developer according to the present invention is based on the first, second or third blade of the developing device using the one-component developer, wherein the blade is preferably made of a material prepared by tempering SUS301-CSP specified by JIS G4313 to 3/4H, H or EH, or tempering SUS304-CSP to 3/4H or H.

According to this invention, the blade is made of a material prepared by tempering SUS301-CSP specified by JIS G4313 (spring-use stainless steel strip) to 3/4H, H, or EH, or tempering SUS304-CSP to 3/4H or H.

Consequently, it is possible to ensure the straightness of the contact plane of the blade with the development roller and form a satisfactory developer layer over the entire width of the development roller in the axis direction.

A fifth blade of a developing device using a one-component developer according to the present invention is based on any one of the first to fourth blade of the developing device using the one-component developer, wherein the blade is preferably bent to have a bend line in a direction perpendicular to a rolling direction of a thin plate material.

According to the above invention, the rolling direction of the blade during bending is specified by bending the blade to have a bend line in a direction perpendicular to the rolling direction of the thin plate material during the fabrication of the blade. Consequently, it is possible to minimize the influence of distortion which was caused during rolling and present originally in the material of the blade on the straightness of the contact plane of the blade with the development roller.

As a result, the straightness of the contact plane of the blade with the development roller is ensured, and a satisfactory developer layer can be formed over the entire width of the development roller in the axis direction.

A sixth blade of a developing device using a one-component developer according to the present invention is based on any one of the first to fifth blade of the developing device using the one-component developer, wherein the blade is preferably annealed before bending.

According to the above invention, it is possible to eliminate the distortion of the material caused during rolling and ensure the straightness of the contact plane of the blade with the development roller by annealing the blade material before bending. Therefore, a satisfactory developer layer can be formed over the entire width of the development roller in the axis direction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A blade of a developing device, for stably supplying a one-component developer to a development roller for carrying the one-component developer on a surface thereof, said blade having elasticity and comprising a linear contact section which is pressed and brought into contact with the surface of the development roller, and an inclined section which extends at an angle from an end of the contact section so as to form a flare at an inflow section of the one-component developer between said blade and development roller, said contact section of said blade being in plane contact with said development roller, said inclined section being formed so that an angle θ, in the flare at the inflow section, between the inclined section and a line tangent to the development roller at the contact section, has a value that stabilizes an amount of the one-component developer carried on the development roller wherein the inclined section is formed such that the angle θ satisfies $30° \leqq \theta \leqq 60°$.

2. The blade of the developing device as set forth in claim 1, wherein said blade is made of a metal plate, and the inclined section is formed by mechanical bending.

3. The blade of the developing device as set forth in claim 1, wherein said blade is made of a metal plate formed by tempering a stainless steel.

4. The blade of the developing device as set forth in claim 1, wherein said blade is made of a metal plate obtained by rolling, and the inclined section is formed by performing mechanical bending so that a bend line is formed in a direction which is determined according to a rolling direction of the metal plate.

5. The blade of the developing device as set forth in claim 4, wherein the bend line is formed in a direction perpendicular to the rolling direction.

6. The blade of the developing device as set forth in claim 4, wherein said blade is annealed before mechanical bending.

7. The blade of the developing device as set forth in claim 1, wherein the development roller contact section of the blade has a width of about 1 mm in a rotation direction of said development roller.

8. The blade of the developing device as set forth in claim 1, wherein the development roller contact section of the blade is formed substantially in a same direction as the line tangent to said development roller.

9. A developing device comprising:

a development roller which is disposed to face a photoreceptor having a surface on which an electrostatic latent image is formed, carries a one-component developer on a circumferential surface thereof, and is rotated so as to develop the electrostatic latent image on said photoreceptor with the one-component developer; and a blade with elasticity which is pressed and brought into contact with the circumferential surface of said development roller so as to form a thin layer of the one-component developer, said blade having a linear contact section which is in plane contact with the circumferential surface of said development roller, and an inclined section which extends from an end of the contact section so as to form a flare at an inflow section of the one-component developer between said blade and development roller, said contact section of said blade being in plane contact with said development roller, said inclined section being formed so that an angle θ in the flare at the inflow section, between the inclined section and a line tangent to said development roller at the contact section, has a value that stabilizes an amount of the one-component developer carried on said development roller wherein the inclined section is formed such that the angle θ satisfies $30° \leqq \theta \leqq 60°$.

10. The developing device as set forth in claim 9, wherein said blade is made of a metal plate, and the inclined section is formed by mechanical bending.

11. The developing device as set forth in claim 9, wherein said blade is made of a metal plate formed by tempering a stainless steel.

12. The developing device as set forth in claim 9, wherein said blade is made of a metal plate obtained by rolling, and the inclined section is formed by performing mechanical bending so that a bend line is formed in a direction which is determined according to a rolling direction of the metal plate.

13. The developing device as set forth in claim 12, wherein the bend line is formed in a direction perpendicular to the rolling direction.

14. The developing device as set forth in claim 14, wherein said blade is annealed before mechanical bending.

15. The developing device as set forth in claim 9, wherein the contact section of said blade comes into contact with the circumferential surface of said development roller along a rotation axis direction of said development roller.

16. The developing device as set forth in claim 9, wherein the circumferential surface of said development roller is made of an elastic material.

17. The developing device as set forth in claim 9, wherein each of said photoreceptor and development roller has a cylindrical external shape, and rotation axes of said photoreceptor and development roller are arranged parallel to each other.

18. The developing device as set forth in claim 9, wherein a base section of said blade is mounted to a main body of said developing device, and a tip section of said blade, which includes the contact section and inclined section, is a free end.

19. The developing device as set forth in claim 9, wherein the development roller contact section of the blade has a width of about 1 mm in a rotation direction of said development roller.

20. The developing device as set forth in claim 9, wherein the development roller contact section of the blade is formed substantially in a same direction as the line tangent to said development roller.

* * * * *